US005392096A

United States Patent [19]

Deets, II

[11] Patent Number: 5,392,096

[45] Date of Patent: Feb. 21, 1995

[54] IMAGE TRANSFER METHOD

[75] Inventor: Robert M. Deets, II, Cochranton, Pa.

[73] Assignee: Morco, Cochranton, Pa.

[21] Appl. No.: 170,898

[22] Filed: Dec. 21, 1993

[51] Int. Cl.[6] ..... G03G 15/00

[52] U.S. Cl. ..... 355/202; 156/277; 101/129; 355/279; 430/126

[58] Field of Search ..... 355/271, 278, 273, 277, 355/279, 282, 285, 289, 290, 295, 200, 202; 156/277, 235, 240; 430/97, 126, 124; 101/129, 113

[56] References Cited

U.S. PATENT DOCUMENTS

| | | | |
|---|---|---|---|
| 2,855,324 | 10/1958 | Van Dorn | 117/25 |
| 2,886,464 | 5/1959 | Van Dorn | 117/17.5 |
| 3,386,847 | 6/1968 | McDermott | 117/36.4 |
| 3,658,519 | 4/1972 | Menz | 96/1.4 |
| 3,721,557 | 3/1973 | Inoue | 96/28 |
| 3,799,827 | 3/1974 | Takimoto et al. | 156/219 |
| 3,833,293 | 9/1974 | Serio et al. | 355/17 |
| 3,854,942 | 12/1974 | Akman | 96/1.2 |
| 3,955,530 | 5/1976 | Knechtel | 118/60 |
| 4,064,285 | 12/1977 | Mammino | 427/24 |
| 4,066,802 | 1/1978 | Clemens | 427/24 |
| 4,216,283 | 8/1980 | Cooper et al. | 430/126 |
| 4,234,673 | 11/1980 | Scrutton et al. | 156/235 X |
| 4,262,071 | 4/1981 | Larson | 430/11 |
| 4,329,420 | 5/1982 | Bopp | 430/293 |
| 4,333,986 | 6/1982 | Leszyk | 430/12 |
| 4,376,158 | 3/1983 | Spechler | 430/291 |
| 4,510,225 | 4/1985 | Kuehnle et al. | 430/126 |
| 4,621,009 | 11/1986 | Lad | 428/216 |
| 4,657,831 | 4/1987 | Ambro et al. | 430/14 |
| 4,865,938 | 9/1989 | Sakai et al. | 430/138 |
| 4,937,105 | 6/1990 | Sakai et al. | 427/366 |
| 4,992,833 | 2/1991 | Derimiggio | 355/282 |
| 5,019,475 | 5/1991 | Higashiyama et al. | 430/138 |
| 5,071,728 | 12/1991 | Watts | 430/126 |
| 5,093,689 | 3/1992 | Imaeda | 355/279 |
| 5,217,841 | 6/1993 | Ishikawa | 430/256 |
| 5,246,518 | 9/1993 | Hale | 156/230 |
| 5,248,363 | 9/1993 | Hale | 156/230 |
| 5,253,021 | 10/1993 | Aslam et al. | 355/271 |
| 5,261,987 | 11/1993 | Luening et al. | 156/235 |
| 5,277,501 | 1/1994 | Tanuka et al. | 156/240 X |
| 5,306,374 | 4/1994 | Hambright | 156/240 X |
| 5,324,378 | 6/1994 | Sieber | 156/240 |

FOREIGN PATENT DOCUMENTS

| | | |
|---|---|---|
| 0094845 | 5/1983 | European Pat. Off. . |
| 1568226 | 12/1975 | United Kingdom . |
| 1570201 | 12/1975 | United Kingdom . |
| 2079219 | 7/1980 | United Kingdom . |

*Primary Examiner*—Matthew S. Smith
*Attorney, Agent, or Firm*—Lovercheck and Lovercheck

[57] ABSTRACT

A process of transferring a copy of a color picture, or other article, to a surface of an entity or sheet, by copying the color picture on a carrier sheet of paper or plastic with a color copier machine forming a toner image of the article. The toner image is rested on the surface of an entity to receive the picture. Heat and pressure are then applied to the carrier sheet thereby remelting the toner copy in contact with the surface of the article or sheet thereby transferring the copy to the entity and the carrier sheet is removed.

9 Claims, 1 Drawing Sheet

IMAGE TRANSFER METHOD

BACKGROUND OF THE INVENTION

There is a current need for a new method of transferring color copies of pictures on various articles of manufacture that have a smooth exposed surface that are cheap, simple, and suitable for single images or low volume production.

The advent of electrophotographic copying, commonly referred to as xerography or plain paper copying, has proved to be a highly successful process for reproduction of images on to paper with the inherent advantages of speed and reliability. In a conventional process, an electrostatic image of an object is formed on a recording member such as a plate or drum. The recording member may comprise a layer of photoconductive material, such as selenium, or a conductive metal layer. The latent electrostatic image which is formed on the photoconductive material is developed into a visible image by application of toner powder or liquid and the image is transferred to a sheet of paper and affixed thereon by fusing, e.g., by application of heat and pressure to form a permanent print. Full color images may be obtained by sequentially forming electrostatic color separation images on the recording member and using magenta, cyan, yellow and black toners in turn.

More recent developments in plain paper copiers include the ability to electronically store and image and output the image in sections at a predetermined level of magnification. Thus, a relatively large image may be output as a series of A4 or A3 sized sections ("tiled"), each of which bears a portion of the final image. When the tiles are placed in edge-to-edge abutment (after trimming any overlaps), the complete image is displayed.

SUMMARY OF THE INVENTION

The copying machine must be one of the types that use thermoplastic or meltable toner to form melted toner images to the carrier sheet where it is remelted in contact with an entity. Such dry toner machines are manufactured by the Canon Company, the Kodak Company and the Xerox Company.

Copy machines that use ink to form the images on a carrier sheet are not suitable for applicant's process since most inks cannot be remelted.

The carrier sheet is a sheet of heat resistant material that will not be damaged at the temperatures that are needed to reheat the toner used in the machine. Any suitable sheet material, transparent or opaque can be used for the carrier sheet so long as it will not be damaged by remelting the toner.

The reheating means can be a platen type with a means to apply pressure and heat to the carrier sheet, or it could be of a drum, or belt type machine, that applies pressure to the work.

Entities to which the image is transferred can be any sheet of plastic or paper article having either a smooth, flat, or curved surface suitable to receive the transferred image. The present invention provides a simple efficient method of reproducing an image on an article of manufacture such as color pictures or plastic clips for holding papers together, or other articles having a relatively flat, smooth surface or on any suitable sheet material to receive the remelted image.

The method according to the invention comprises the following:

a. Providing a carrier sheet capable of withstanding exposure to temperatures of at least equal to the remelting temperature of toner to be used.

b. Applying the image of the article to the carrier by the passage of the carrier sheet through the copying apparatus so that the toner image is melted onto the carrier sheet.

c. Resting the carrier sheet on the article with the toner image resting on the entity.

d. Applying heat and pressure to the carrier sheet whereby the toner image is remelted and transferred from the carrier sheet to the entity and the carrier sheet is removed.

It is an object of the invention to provide an improved copying method.

It is another object of the present invention to provide a transfer method that is simple, economical and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
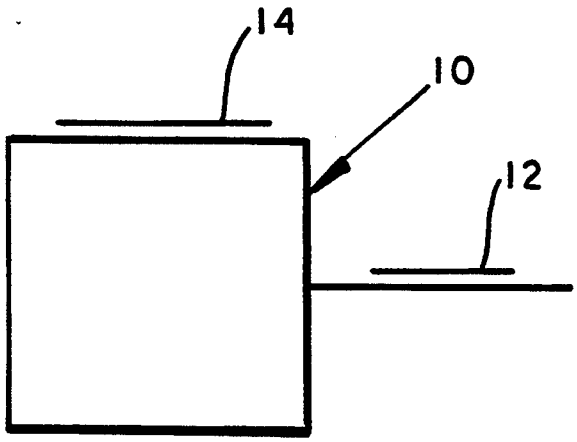
FIG. 1 is a diagrammatic view of a color type copying machine using a color toner with a carrier sheet and article to be copied on the carrier.
Figure 2:
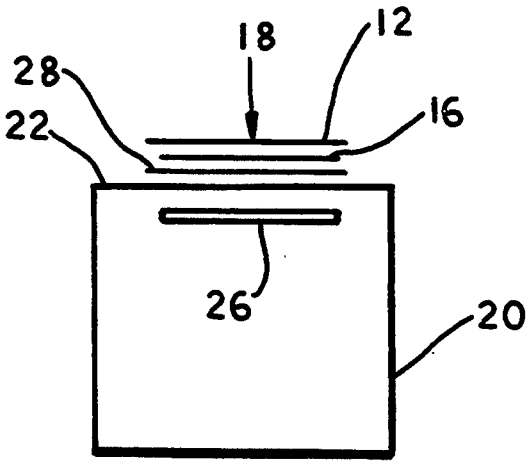
FIG. 2 is a side view of a heater and pressure means with a carrier sheet with toner images on it and an entity which may be a sheet to receive the images according to the invention.

Now with more particular reference to the drawings, in its basic form, the invention involves transferring a copy of a color photograph, picture or other article 14, such as an even, flat surface of a three dimensional article, to carrier sheet 12. Carrier sheet 12 could be made of transparent plastic material that may be, for example, 0.001 to 0.005 inches thick and it could be made of paper or other material that will withstand the temperatures necessary to remelt toner images 16.

In carrying out the method according to the invention, a copy of article 14 is made by a dry toner copier machine 10 thereby providing toner image 16 on carrier sheet 12. Carrier sheet 12 is then moved to pressure and heat machine 20. Carrier sheet 12 is then supported on platen 22 of pressure and heat machine 20 with toner image 16 in contact with a flat or even surface of entity 28. Heat machine 20 has pressure means 18 and heater 26.

Heat and pressure are then applied to carrier sheet 12, remelting toner image 16 and forcing toner image 16 against entity 28 so that the remelted plastic of toner image 16 adheres to entity 28. Heat and pressure can then be removed. Thus, an image of article 14 will be affixed to entity 28 thereby forming a faithful reproduction of original article 14. Several pictures or other articles could be arranged on copier machine 10 and copied on carrier sheet 12.

The foregoing specification sets forth the invention in its preferred, practical forms put the structure shown is capable of modification within a range of equivalents without departing from the invention which is to be understood is broadly novel as is commensurate with the appended claims.

The embodiments of the invention in which an exclusive property or privilege is claimed are defined as follows:

1. A printing process comprising providing a color copier machine of the dry toner type;

providing a plain, non-laminated, non-electrically conductive carrier sheet adapted to accept a melted toner image and to withstand temperatures of remelting toner images;

providing an article to be copied;

copying an image of said article onto said plain carrier sheet by a xerographic process using a toner including melting said toner thereby providing said toner image of said article on said plain carrier sheet;

bringing said toner image on said plain carrier sheet into contact with an entity;

applying both heat and pressure to said plain carrier sheet to remelt said toner image and to force said toner image into contact with said entity; and, cooling said remelted toner image.

2. The method of claim 1 wherein a plurality of said remelted toner images are affixed to said carrier sheet.

3. The method of claim 1 wherein said article is an article of manufacture.

4. The method of claim i wherein said article is a color picture.

5. The method of claim 1 wherein said article is a color photograph.

6. The method of claim 1 wherein said entity is a sheet of plastic.

7. The method of claim 1 wherein said entity is an article of manufacture.

8. A method of transferring a color picture comprising, providing a color copier machine of the dry toner type, which includes means to melt toner images;

a plain, non-laminated, non-electrically conductive carrier sheet and a heating machine for applying heat to a toner image;

making said toner image of said color picture on said plain carrier sheet by means of said color copier machine thereby melting said toner image;

resting said toner image on an entity; and, applying heat and pressure to said plain carrier sheet and said toner image to remelt said toner image whereby said toner image is transferred to said entity.

9. The method of claim 8 further providing copying a plurality of said color pictures onto said carrier sheet;

resting said toner image on said entity;

applying heat and pressure to said carrier sheet thereby transferring said toner image to said entity.

* * * * *